US006182386B1

(12) United States Patent
Nielsen

(10) Patent No.: US 6,182,386 B1
(45) Date of Patent: Feb. 6, 2001

(54) SIGN HAVING A MOVABLE FRONT PLATE

(75) Inventor: Kaj Clausen Nielsen, Billund (DK)

(73) Assignee: A/S Modulex, Billund (DK)

( * ) Notice: Under 35 U.S.C. 154(b), the term of this patent shall be extended for 0 days.

(21) Appl. No.: 09/199,494

(22) Filed: Nov. 25, 1998

(30) Foreign Application Priority Data

Nov. 28, 1997 (DK) ..... 1377/97

(51) Int. Cl.[7] ..... G09F 11/00
(52) U.S. Cl. ..... 40/491; 40/488
(58) Field of Search ..... 40/491, 488, 496; 273/153 S; 434/322, 327, 347, 348, 364

(56) References Cited

U.S. PATENT DOCUMENTS 4,165,572 8/1979 Sussman .
4,176,484 12/1979 Terris .
4,196,529 * 4/1980 Esbensen ..... 434/348
5,255,462 10/1993 Rufenacht .
5,269,086 12/1993 Tomes .

FOREIGN PATENT DOCUMENTS 206913 11/1923 (GB) .
1 459 845 12/1976 (GB) .
8101483 7/1984 (SE) .

* cited by examiner

*Primary Examiner*—C. Davis
(74) *Attorney, Agent, or Firm*—Pitney, Hardin, Kipp & Szuch LLP

(57) ABSTRACT

A sign is provided having a rear plate (2) having at least two printed messages (5,6) and a front plate (3) arranged movably in front of the rear plate (2). The front plate (3) is arranged such that in its starting position it covers all the messages (5,6) on the rear plate (2), and that, by movement, it may be caused to expose at least one of the messages (5,6).

9 Claims, 5 Drawing Sheets

SIGN HAVING A MOVABLE FRONT PLATE

BACKGROUND OF THE INVENTION

The invention relates to a sign comprising a rear plate having at least two sections arranged in a row and a front plate movably arranged in front of the rear plate so that the front plate may be caused to cover or uncover one or more sections.

Such a sign is known from e.g. DE-01-295 16 232 which shows a sign comprising a rear plate with two printed messages, a transparent cover plate and a front plate movably arranged between the rear plate and the cover plate. The rear plate is provided with two printed messages—"Unoccupied" and "Occupied"—and the movable front plate has a size such that it covers one message in its one extreme position, while it covers the other message in its other extreme position.

Another sign is known from U.S. Pat. No. 5,255,462. This sign comprises a front plate, a rear plate and a movable indicator plate. At one end the movable indicator plate has printed thereon an arrowhead which points in a direction opposite to an arrowhead printed at the other end of the indicator plate. The movable indicator plate is provided with a handle so that it may be placed in a position in which it is covered completely by the front plate, where just one arrowhead is visible, while the other is covered by the front plate, and vice versa. A line is printed on the front plate so that the sign can show either just a line or one of two oppositely directed arrows.

Known are also signs where a movable element may be caused to cover one message, while another message is exposed, see e.g. U.S. Pat. No. 4,217,713 and U.S. Pat. No. 4,654,990.

It is common to these signs that the movable element can be moved only in one dimension and can thereby just either expose a first message or a second message, depending on whether the movable element is in its one extreme position or its other extreme position.

SUMMARY OF THE INVENTION

The object of the present invention is to provide a sign which is more flexible in use than the known signs.

This is achieved by arranging the sign stated in the opening paragraph such that the rear plate additionally comprises at least one section staggered with respect to the row, and in that the sign is arranged such that the front plate may be moved in two dimensions relative to and in a plane parallel with the rear plate so that the front plate may be caused to cover or uncover sections in the row as well as sections staggered with respect to the row.

This provides a sign which may be caused to show one of several possible sections which may contain messages, merely by moving a single element—the front plate.

Preferably, both the rear plate and the front plate are rectangular, and the sections are arranged on the rear plate immediately within the edge of the front plate when this is in its starting position. This provides a sign in its simplest form which can readily replace the greater part of the known signs.

In particular preferred embodiment of a rectangular sign, a section is arranged on the rear plate immediately within each edge of the front plate when this is in its starting position, and the sign is arranged such that the front plate may be moved in all directions to expose one or two sections at the same time. When the sign is arranged in this manner, then selectively, just one out of four different sections may be displayed, or two sections may be displayed at the same time.

In a practical embodiment, the sign comprises a movable element arranged between the rear plate and the front plate, said movable element being movably mounted in the rear plate in a first direction, and the front plate is movably mounted in the movable element in a second direction perpendicular to the first section. It is ensured hereby that the front plate may be moved in all directions to expose one or more sections.

To increase the flexibility of the sign, the rear plate may advantageously comprise a removable transparent intermediate plate which covers and holds a notice with said messages, and preferably the intermediate plate is provided with rearwardly directed flaps capable of snappingly engaging complementary recesses provided in a mounting plate which forms part of the rear plate. This allows easy replacement of messages on the rear plate, as this just requires that the intermediate plate is removed and a new notice is inserted into the rear plate.

In a preferred embodiment, the front plate comprises a removable transparent cover which covers and holds a notice, said transparent cover being preferably mounted by means of a snap closure. This also allows easy and quick replacement of the notice on the front plate.

In particularly preferred embodiment, the front plate has the same size as a credit card or a visiting card, so that cards of this standard size may be used in the sign.

BRIEF DESCRIPTION OF THE DRAWINGS

The invention will now be explained more fully with reference to the drawing, in which.

DETAILED DESCRIPTION OF THE INVENTION

Figure 1A:
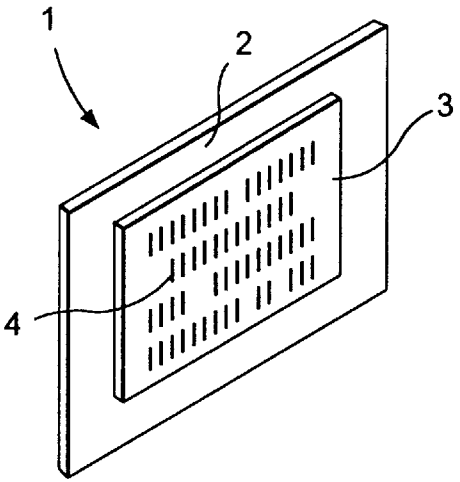
FIGS. 1*a*–1*d* show a sign according to the invention in a preferred embodiment with the front plate in the starting position (FIG. 1*a*) and displaced in different directions (FIGS. 1*b*–1*d*)

A sign 1 according to the invention is shown in FIGS. 1*a*–1*d*. The sign 1 is primarily useful as a name sign outside an office, but other uses of the sign 1 are also conceivable, as it may e.g. be arranged as a sign to be placed on a table.

The sign 1 comprises a rear plate 2 and a front plate 3, which is arranged in front of the said plate, and which may contain information in the form of text 4 on e.g. the name and the occupation of the person occupying that office. The front plate 3 is arranged to be movable in all directions relative to the rear plate 2 and may be caused, by moving, to expose one or more messages provided on the rear plate 2, as will appear from FIGS. 1*b*–1*d*. The messages may e.g.

be text such as "Occupied", "Unoccupied", "At lunch", "Meeting", "The door is open", etc.

Various messages 5 and 6 are provided on the rear plate 2 and may be exposed, as desired, by moving the front plate 3. In the starting position shown in FIG. 1*a*, none of the messages 5, 6 is exposed, and the sign then just contains information on e.g. the name and the occupation of the person occupying the office, via the text 4 on the front plate 3.

Figure 1B:
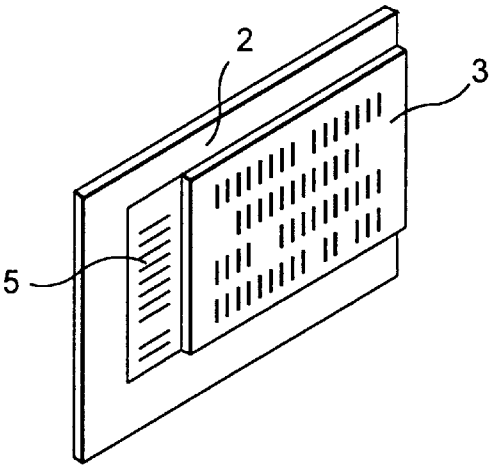
Figure 1C:
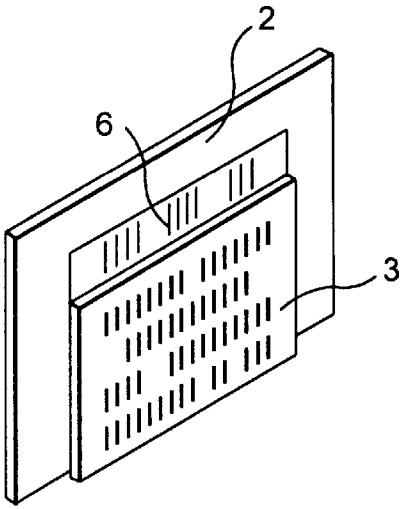
Figure 1D:
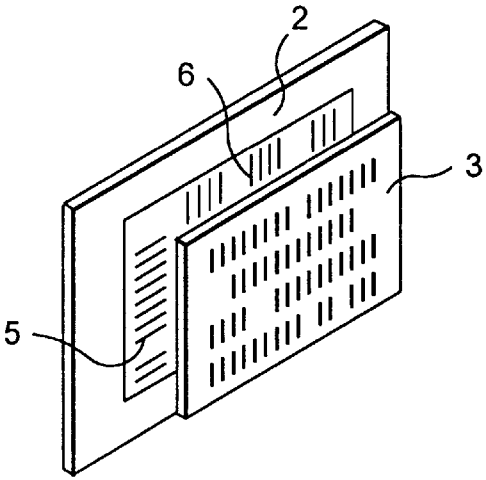

In FIG. 1*b*, the front plate 3 is displaced to the right so that the message 5 is exposed, while the front plate 3 is displaced downwards in FIG. 1*c* so that the message 6 is exposed. In FIG. 1*d*, the front plate 3 is displaced both to the right and downwards so that the message 5 as well as the message 6 is exposed. Thus, with the sign 1 it is possible selectively to expose one or two messages or none at all.

The sign 1 may be provided with two more messages which may be exposed by displacing the front plate 3 to the left and/or upwards.

Figure 2:
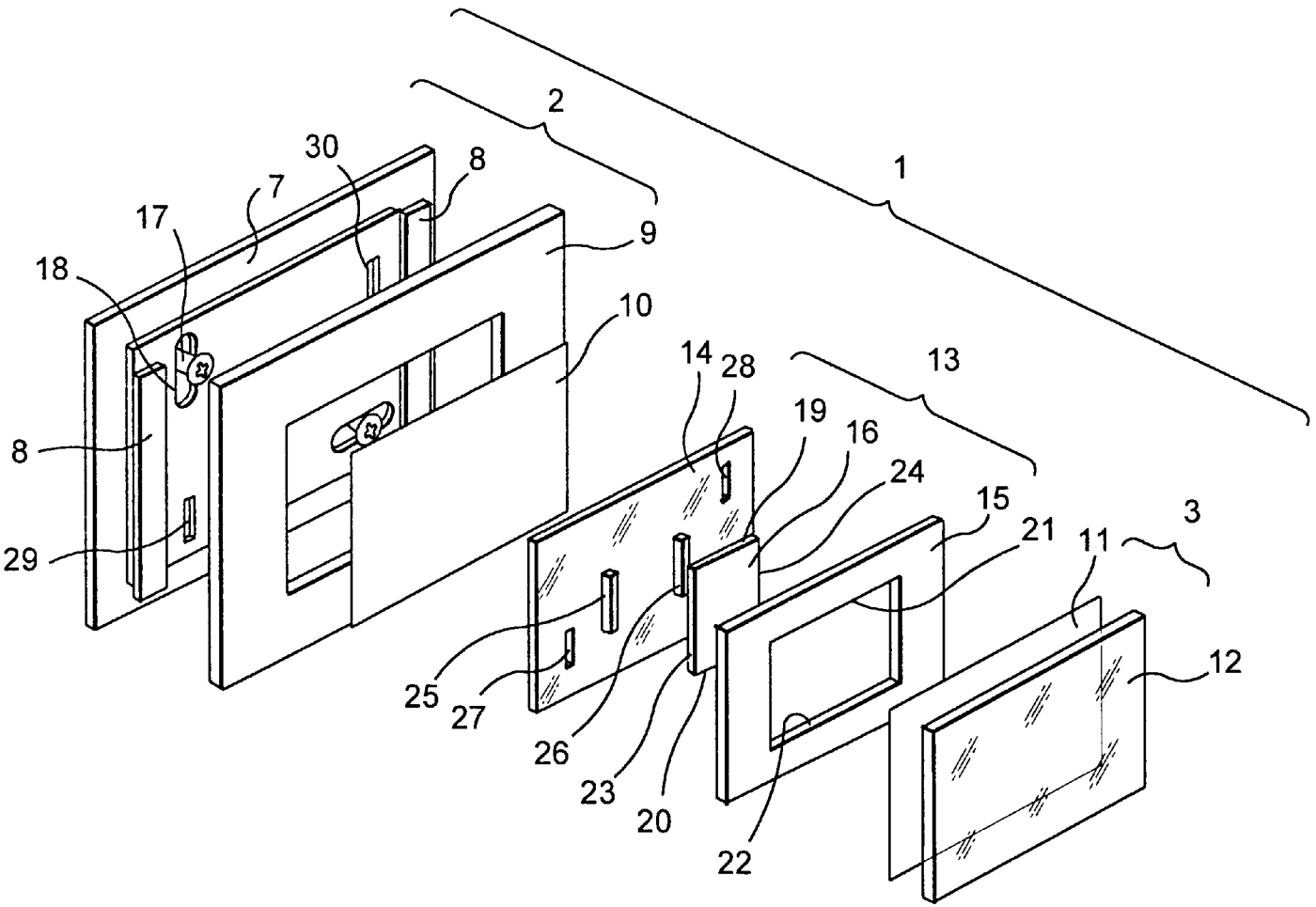
FIG. 2 shows the sign of FIG. 1 in a disassembled state.

In FIG. 2, the sign 1 is shown disassembled to illustrate its structure in a preferred embodiment. As will appear, the rear plate 2 comprises a mounting plate 7, double-sided adhesive strips 8, an outer frame 9 and a notice 10. The front plate 3 comprises a notice 11 and a transparent cover 12. The connection between the rear plate 2 and the front plate 3 takes place via a movable part 13, which comprises a transparent intermediate plate 14, a movable frame 15 and a movable element 16 which is mounted movably in one direction in the intermediate plate 14 and in a direction perpendicular to it in the movable frame 15.

To mount the sign 1 on a wall, the mounting plate 7 is first mounted on the wall by means of screws 17 through mounting holes 18 provided in the mounting plate 7. The double-sided adhesive strips 8 are adhered to the mounting plate 7, and the outer frame 9 is pressed on to the adhesive strips 8. Then a notice 10 is inserted loosely into the rear plate 2 now mounted. The outer frame 9 has a significant influence on the appearance of the sign 1, and this may therefore advantageously be available in different colours and materials, so that the appearance of the sign 1 may be varied by replacing the frame 9.

The movable part 13 is assembled by placing the movable frame 15 over the movable element 16 so that the upper and lower edges 19, 20 of the movable element 16 grip behind the inner upper and lower edges 21, 22 of the frame 15, following which the sides 23, 24 of the movable element 16 are pressed down between two projections 25, 26 on the transparent intermediate plate 14. The frame 15 may now be moved vertically as well as horizontally with respect to the intermediate plate 14.

The movable part 13 is then mounted on the rear plate 2, the intermediate plate 14 being provided with rearwardly directed flaps 27, 28 which are capable of snappingly engaging complementary holes 29, 30 in the mounting plate 7. Finally a notice 11 is placed in the transparent cover 12, which is then mounted on the movable frame 15, as it grips behind this by snap engagement.

As the transparent intermediate plate 14 is mounted in the mounting plate 7 by snap engagement, the notice 10 may easily be replaced, if so desired. The notice 11 may also be replaced easily, as the transparent cover 12, too, is in snap engagement with the movable frame 15. The sign 1 thus exhibits great flexibility both with respect to the display of messages 5, 6 and with respect to easy replacement of messages/information.

In a particularly advantageous embodiment, the sign 1 is standardized in size so that the notice 11 has the same size as a credit card (which conventionally are approximately 8.5×54 cm) or a visiting card. The sign 1 may hereby be used in many different connections with notices 11 which have this standard size.

FIGS. 3*a*–3*d* correspond to FIGS. 1*a*–1*d*, with the notice 11 and the cover 12 removed to illustrate how the elements of the movable part 13 are moved with respect to each other when the front plate 3 is moved with respect to the rear plate 2.

Figure 3A:
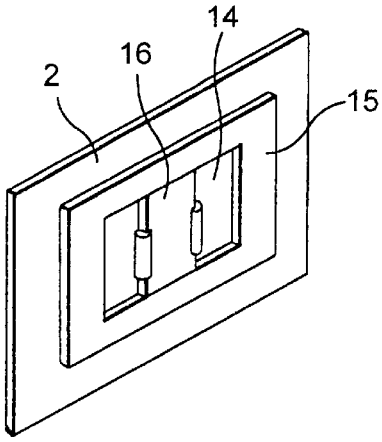
FIGS. 3*a*–3*d* show the same as FIGS. 1*a* –1*d*, but without notice and transparent cover on the front plate.
Figure 3B:
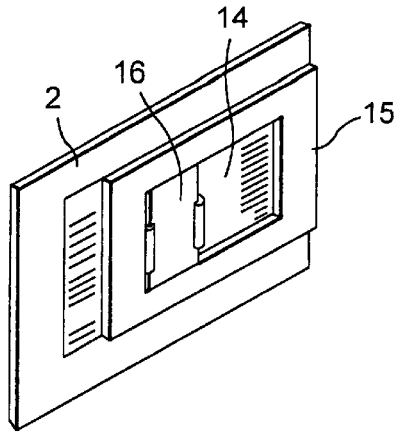
Figure 3C:
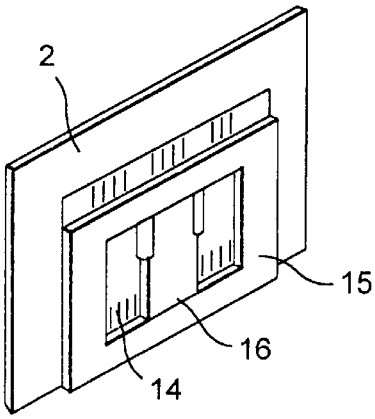
Figure 3D:
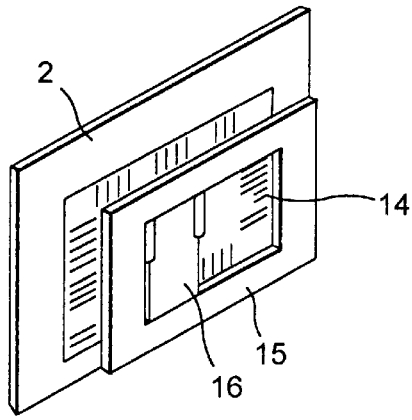

FIGS. 3*a*, like FIG. 1*a*, shows the sign 1 in the starting position where all the messages are covered by the movable frame 15. It will be seen in FIG. 3*b* how the frame 15 is moved to the right with respect to the movable element 16, while FIG. 3*c* shows how the movable element 16 is moved downwards with respect to the transparent intermediate plate 14. In the position shown in FIG. 3*d*, both movements take place simultaneously.

Figure 4A:
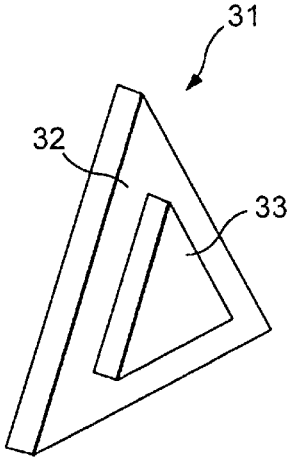
FIGS. 4*a*–4*c* show a sign in an alternative embodiment with the front plate in the starting position (FIG. 4*a*) and displaced in different directions (FIGS. 4*b*–4*c*)
Figure 4B:
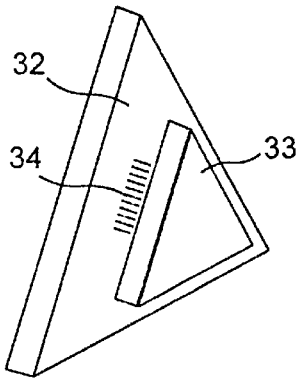
Figure 4C:
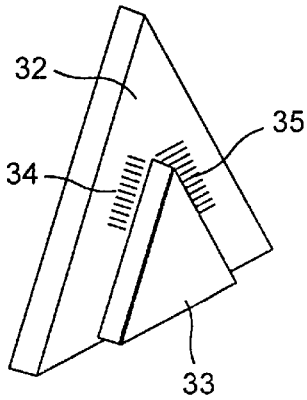

FIG. 4*a* shows an alternative embodiment of a sign according to the invention. Here, too, the sign 31 comprises a rear plate 32 and a front plate 33 which is movably mounted on the rear plate 32. Both the rear plate 32 and the front plate 33 are triangular in this embodiment, and the sign 31 is thus provided with 3 different messages 34, 35 which may be exposed separately as shown in FIG. 4*b*, or two in combination as shown in FIG. 4*c*. The front plate 33 may be provided with information in this embodiment, too, which however, is not shown.

The structure of the sign 31 may correspond completely to the structure of the sign 1 shown in FIG. 3, but it may also be constructed differently, e.g. as shown in FIGS. 5*a*–5*b* and FIGS. 6*a*–6*b*.

Figure 5A:
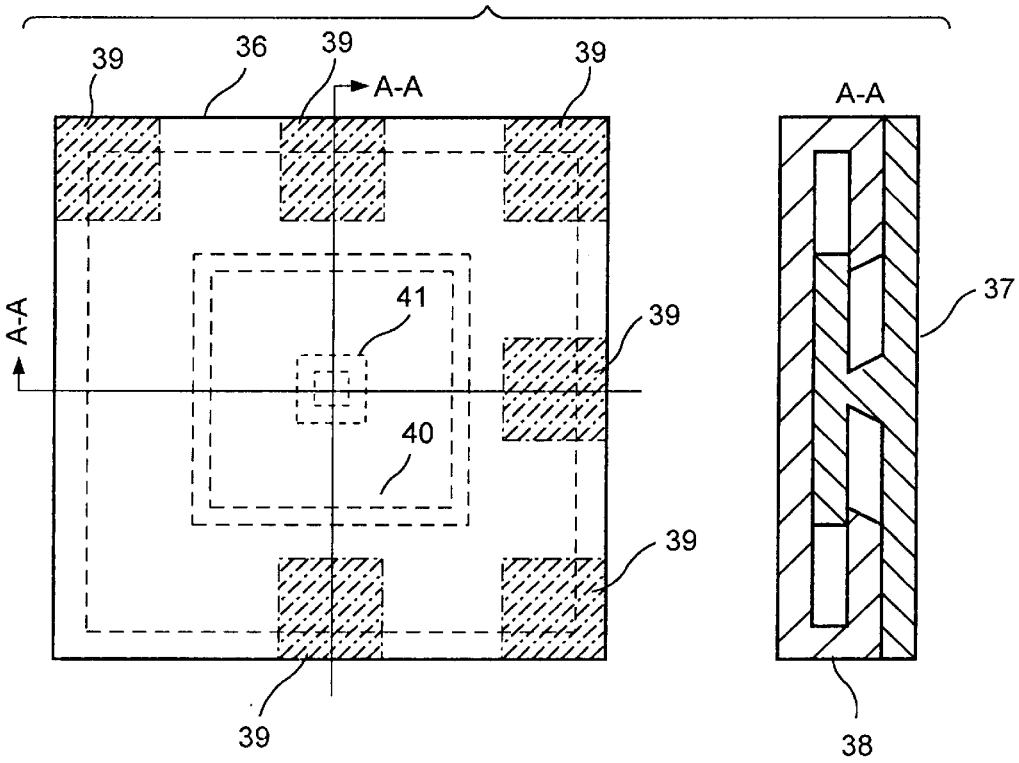
FIGS. 5*a*–5*b* show another alternative embodiment of a sign with the front plate in the starting position (FIG. 4*a*) and in an extreme position (FIG. 5*b*)

FIG. 5*a* shows an embodiment in which a front plate having a rearwardly directed pin having a large head grips behind the edge of a central hole. The sign 36 is shown in front view and in cross-section A—A. The sign is provided with text sections 39 which may be exposed as needed by moving the front plate 37 with respect to the rear plate 38. The rear plate 38 of the sign is provided with a hole 40 which is sufficiently large for the rearwardly directed pin 41 of the front plate to be moved within the cross-section of the hole.

Figure 5B:
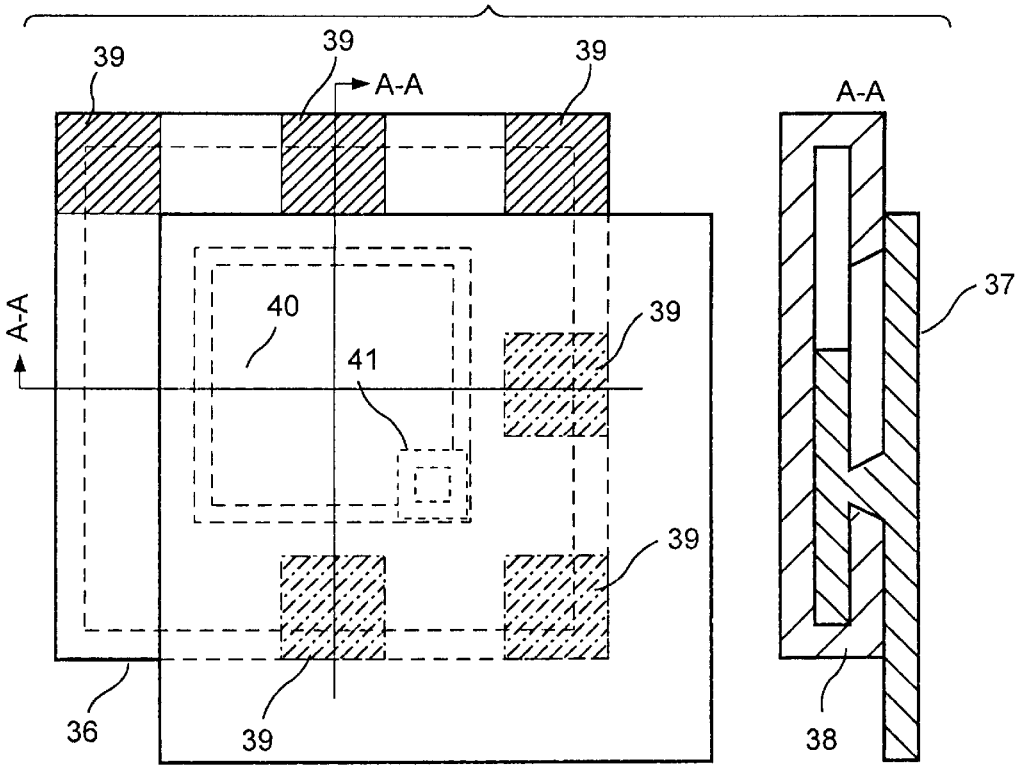

FIG. 5*b* shows the same embodiment as in FIG. 5*a*, but in a situation where the front plate is in an extreme position. It is shown in this situation how three text sections 39 are exposed.

Figure 6A:
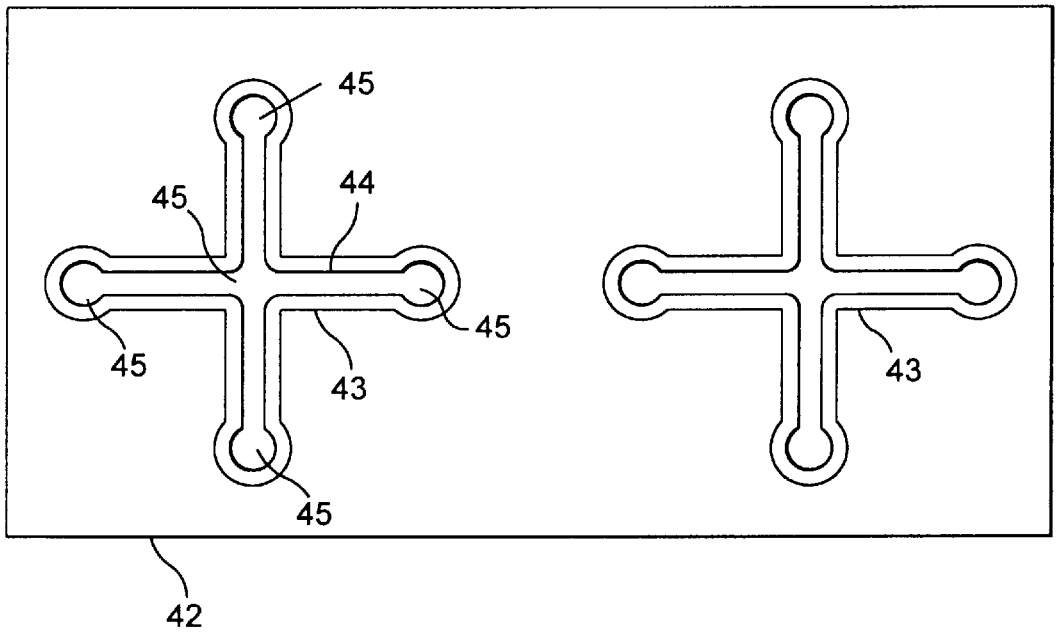
FIGS. 6*a*–6*b* show a further embodiment of a sign where the front plate (FIG. 6*b*) is guided by a track in the rear plate (FIG. 6*a*).

FIG. 6*a* shows an embodiment of a rear plate in which a track is provided. The rear plate 42 may e.g. be of a plastics material in which one or more cross-shaped tracks 43 are formed. The cross-shaped track is provided such that a front plate (not shown) may be held in some predetermined positions 45. When the track 43 is formed with an edge 44 clamping a pin on the front plate, it is ensured that the front plate of the sign is held particularly well in the determined positions 45.

Figure 6B:
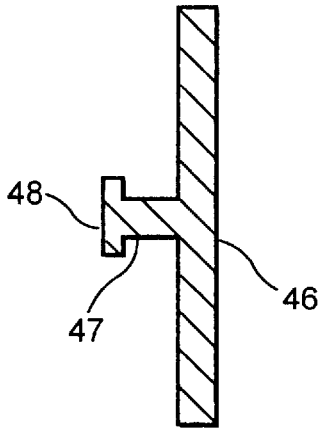

FIG. 6*b* shows a cross-section through an embodiment of a front plate provided with a rearwardly directed pin capable of engaging behind the edge of a track in a rear plate. The front plate 46 is provided with a rearwardly directed pin 47 having a large head 48. The front plate may hereby be moved with respect to the rear plate along a predetermined track to expose or uncover messages.

Other embodiments of the sign than those shown and described here are also possible, just as the device for moving the front plate with respect to the rear plate may also be produced in other ways than those shown and described without departing from the idea of the invention.

For example, the messages 5, 6, 34, 35, which are indicated as text in the foregoing, may be formed by symbols or other forms of graphics. Similarly, the information on the front plate 3, 33 may also consist of other graphic elements than text.

Instead of being mounted on a wall, the sign may also be provided with rearwardly directed means to support the sign, so that it may e.g. be placed on a table or the like.

It is also possible to arrange the sign such that it comprises more than one front plate, if the sign e.g. is to be used outside an office occupied by more than one person. The rear plate may thus be made with a suitable number of openings, e.g. three, each of which may receive a movable front plate.

Finally, the outer shape of the rear plate need not be rectangular or triangular as shown, but may be varied as desired and needed.

What is claimed is:

1. A sign comprising a rear plate (2, 32) having a least two section (5, 6,34,35) arranged in a row and a front plate (3,33) movably arranged in front of the rear plate (2,32) so that the front plate may be caused to selectively cover and uncover at least one section, said front plate being slidably interconnected with said rear plate, characterized in that the rear plate (2,32) additionally comprises at least one section (5,6,34,35) staggered with respect to the row, and in that the sign is arranged such that the front plate may be moved in two dimension relative to and in a plane parallel with the rear plate (2,32) so that the front plate (3,33) may be caused to selectively cover and uncover at least one section (5,6, 34,35) in the row as well as sections staggered with respect to the row.

2. A sign according to claim 1, characterized in that both the rear plate (2) and the front plate (3) are rectangular, and that the sections (5,6) in the row and as well as sections staggered with respect to the row are arranged on the rear plate (2) immediately within an edge of the front plate (3) when this is in a starting position.

3. A sign according to claim 2, characterized in that a section in a row as well as staggered with respect to a row containing a message (5,6) is arranged on the rear plate (2) immediately with each edge of the front plate (3) when the front plate is in its starting position, and that the front plate (3) may be moved in two directions to expose at least one section.

4. A sign according to claim 1, characterized in that the sign comprises a movable element (16) arranged between the rear plate (2) and the front plate (3), said movable element (16) being mounted movably with respect to the rear plate (2) in a first direction and with respect to the front plate (3) in a second direction perpendicular to the first direction.

5. A sign according to claim 1, characterized in that the rear plate (2) comprises a removable transparent intermediate plate (14) which covers and holds a notice (10) provided with the sections in the row as well as the sections staggered with respect to the row.

6. A sign according to claim 5, characterized in that the intermediate plate (14) has rearwardly directed flaps (27,28) capable of snappingly engaging complementary recesses (29,30) in a mounting plate (7).

7. A sign according to claim 1, characterized in that the front plate (3) comprises a removable transparent cover (12) which covers and holds a notice (11).

8. A sign according to claim 7, characterized in that the transparent cover (12) is mounted by means of snap engagement.

9. A sign according to claim 1, characterized in that the front plate (3) dimensions are approximately 8.5 cm×5.4 cm.

* * * * *